US008273192B2

(12) United States Patent
Xu et al.

(10) Patent No.: US 8,273,192 B2
(45) Date of Patent: Sep. 25, 2012

(54) LEAD-FREE, BISMUTH-FREE FREE-CUTTING PHOSPHOROUS BRASS ALLOY

(75) Inventors: Chuankai Xu, Xiamen (CN); Zhenqing Hu, Xiamen (CN); Siqi Zhang, Changsha (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 0 days.

(21) Appl. No.: 12/644,750

(22) Filed: Dec. 22, 2009

(65) Prior Publication Data

US 2010/0098579 A1 Apr. 22, 2010

Related U.S. Application Data

(63) Continuation-in-part of application No. 12/354,569, filed on Jan. 15, 2009, now abandoned, which is a continuation of application No. 12/208,117, filed on Sep. 10, 2008, now abandoned.

(30) Foreign Application Priority Data

Jun. 11, 2008 (CN) ..... 2008 1 0110819

(51) Int. Cl.
*C22C 9/04* (2006.01)

(52) U.S. Cl. ..... 148/413; 148/434; 420/477; 420/478; 420/479; 420/480

(58) Field of Classification Search ..... 148/411, 148/413, 434; 420/477–480
See application file for complete search history.

(56) References Cited

U.S. PATENT DOCUMENTS

| | | | |
|---|---|---|---|
| 2,149,103 | A | 2/1939 | Schulze et al. |
| 2,215,459 | A | 9/1940 | Canfield et al. |
| 2,255,204 | A | 9/1941 | Best et al. |
| 3,773,504 | A | 11/1973 | Niimi et al. |
| 6,419,766 | B1 | 7/2002 | Ikemiya et al. |

(Continued)

FOREIGN PATENT DOCUMENTS

| | | |
|---|---|---|
| JP | 63130738 | 6/1988 |

(Continued)

*Primary Examiner* — Sikyin Ip
(74) *Attorney, Agent, or Firm* — McDermott Will & Emery LLP

(57) ABSTRACT

The present invention relates to a lead-free, bismuth-free free-cutting phosphorous brass alloy and its method of manufacture. The alloy comprises: Cu; Zn; 0.59 to 1.6 wt % P; and other elements in the amount of 0.005 to 0.6 wt %, which comprise at least two elements selected from the group consisting of Al, Si, Sb, Sn, Rare earth element (RE), Ti and B, and the balance being unavoidable impurities. The phosphorous brass alloy contains a combined wt % of Cu and Zn of between 97.0 wt % and 99.5 wt %, within which the content of Zn is above 40 wt %. Considering the solid solubility of P in the matrix of copper will be decreased rapidly with the temperature decrease and form the brittle intermetallic compounds $Cu_3P$ with Cu, the present invention relies upon P to ensure excellent cuttability of the invented alloy. The invented alloy is reasonably priced, and has excellent cuttability, castability, hot and cold workability, dezincification corrosion resistance, mechanical properties and weldability. The phosphorous brass alloy is a useful alloy for spare parts, forging and castings that require cutting, and particularly in forging and castings for low pressure die casting that requires cutting, grinding, welding and electroplating. The phosphorous brass alloy may also be used for faucets, valves and bushings of water supply systems, and for bar and wire materials that require high corrosion resistance and compactness.

4 Claims, 4 Drawing Sheets

U.S. PATENT DOCUMENTS

| | | | |
|---|---|---|---|
| 6,599,378 | B1 | 7/2003 | Hagiwara et al. |
| 6,942,742 | B2 | 9/2005 | Hatakeyama et al. |
| 2002/0006351 | A1 | 1/2002 | Sugawara |
| 2002/0110478 | A1 | 8/2002 | Lawrence |
| 2004/0241038 | A1 | 12/2004 | Hofmann et al. |
| 2005/0247381 | A1 | 11/2005 | Oishi |

FOREIGN PATENT DOCUMENTS

| | | | |
|---|---|---|---|
| JP | 6192772 | * | 7/1994 |
| JP | 08-120369 | | 5/1996 |
| JP | 63128142 | | 5/1998 |
| JP | 2001059123 | | 3/2001 |
| JP | 2001064742 | | 3/2001 |
| JP | 2006322059 | | 11/2006 |
| KR | 20050087082 | | 8/2005 |
| KR | 2007-101916 | | 12/2006 |
| WO | 2006-136065 | | 12/2006 |

* cited by examiner

LEAD-FREE, BISMUTH-FREE FREE-CUTTING PHOSPHOROUS BRASS ALLOY

CROSS REFERENCE TO RELATED APPLICATIONS

This application is a continuation-in-part of U.S. patent application Ser. No. 12/354,569, filed Jan. 15, 2009, now abandoned, which is a continuation of U.S. patent application Ser. No. 12/208,117 filed on Sep. 10, 2008, now abandoned, which claims priority from Chinese Patent Application No. 200810110819.8 filed Jun. 11, 2008.

FIELD OF THE INVENTION

The present invention generally relates to a phosphorous brass alloy, especially a lead-free and bismuth-free free-cutting phosphorous brass alloy which is applicable in forging and castings for a water supply system.

BACKGROUND OF THE INVENTION

It is well-known that lead-containing brass alloys such as CuZn40Pb1, C36000, C3604 and C3771 usually contain 1.0-3.7 wt % Pb for ensuring excellent free-cuttability.

Lead-containing brass alloys are still widely used in the manufacture of many products due to their excellent cuttability and low cost. However, Pb-contaminated steam produced by the process of smelting and casting lead-containing brass alloy, and Pb-contaminated dust produced in the process of cutting and grinding the lead-containing brass alloy, are harmful to the human body and the environment. If the lead-containing brass alloys are used in drinking-water installations such as faucets, valves and bushings, contamination of the drinking water by Pb is unavoidable. In addition, toys which are produced by Pb-containing brass alloys are more harmful, as they are touched frequently, thus increasing potential exposure to Pb.

Ingestion of lead by humans is harmful, so the use of lead is being strictly banned by law in many countries due to concerns for health and the environment. For dealing with this challenge, metallurgists and manufacturers of copper materials actively research and develop lead-free free-cutting brass alloys. Some of them use Si instead of Pb, but the cuttability is not remarkably improved and the cost increases due to the high quantity of copper. Therefore, silicon brass alloys are not commercially competitive at present. One commonly used type of lead-free free-cutting brass alloy is a bismuth brass alloy, which uses bismuth instead of Pb. Many kinds of bismuth brass alloys with high or low zinc contents have been developed, and their formal alloy grades have been registered in the United States. These kinds of brass alloys contain valuable tin, nickel and selenium, as well as bismuth. Although their cuttability is 85%-97% of lead-containing brass alloy C36000, their cost is far higher than lead-containing brass alloy C36000. Therefore, these kinds of bismuth brass alloys are not competitively priced. Bismuth brass alloys also have been researched and developed in Japan and China, and applications filed in their Patent Offices. Considering that bismuth is expensive, rare in the reserves and has poor cold and hot workability, using a bismuth brass alloy instead of a lead-containing brass alloy may be financially problematic. The invention of a free-cutting antimony brass alloy which uses Sb instead of Pb has been patented in China (ZL200410015836.5). A corresponding U.S. (US2006/0289094) application is currently pending.

DETAILED DESCRIPTION

One object of the present invention is to provide a phosphorous brass alloy which will solve the limitations of conventional brass alloys discussed above, especially the problem of lead contamination and the problem of the high cost of bismuth.

One object of the present invention is to provide a lead-free and bismuth-free phosphorous brass alloy which is excellent in cuttability, castability, hot and cold workability and corrosion resistance, which is not harmful for the environment and the human body, and accomplishes all of these objectives while remaining reasonably priced.

One object of the present invention is to provide a lead-free and bismuth-free free-cutting phosphorous brass alloy which is particularly applicable in forging and castings for components of water supply systems.

One object of the present invention is to provide a manufacturing method for a phosphorous brass alloy.

The objects of the present invention are achieved as follows. The present invention is intended to provide a lead-free, bismuth-free free-cutting phosphorous brass alloy. Considering that the solid solubility of P in the matrix of copper will be decreased rapidly with the temperature decrease, and form the brittle intermetallic compounds $Cu_3P$ with Cu, the present invention elects P as one of the main elements for ensuring the excellent cuttability of the invented alloy and solving the limitations of conventional brass alloy discussed above, especially the environmental problem. The lead-free, bismuth-free free-cutting phosphorous brass alloy of the present invention comprises: Cu and Zn together having a combined wt % of greater than 97% and less than 99.5%, with at least 40 wt % Zn; 0.59 to 1.6 wt % P; and other elements in an amount 0.005 to 0.6 wt %, those other elements comprising at least two elements selected from the group consisting of Al, Si, Sb, Sn, Rare earth element (RE), Ti and B; and the balance being unavoidable impurities.

The present invention is intended to provide a lead-free, bismuth-free free-cutting phosphorus brass alloy wherein the content of P is preferably between 0.59 and 1.35 wt %, more preferably between 0.59 and 0.9 wt % and most preferably between 0.59 and 0.8 wt %. The said other elements are preferably selected from Al, Si, Sb, Ti and B.

The phase compositions of the invented lead-free, bismuth-free free-cutting phosphorus brass alloy includes primarily alpha and beta phase, and a small quantity of intermetallic compounds $Cu_3P$.

In the invented alloy, Pb as an unavoidable impurity, its content is less than 0.02 wt %. Fe as an unavoidable impurity, its content is less than 0.05 wt %.

P is one of the main elements of the invented alloy. Phosphorus serves as a lead substitute. The beneficial effects of P include: ensuring the cuttability of the inventive alloy by the fracture of the brittle intermetallic compounds $Cu_3P$, which is formed by elements P and Cu; improving castability and weldability of the invented alloys as deoxidizers; and improving dezincification corrosion resistance of the invented alloy. The negative effects of P include: decreasing the plasticity of the invented alloy at room temperature; if the intermetallic compounds $Cu_3P$ disperse in the boundary of the crystal grain, the negative influence for plasticity will be larger.

The elements of Rare earth element (RE), Ti and B in the alloy have effects on deoxidization and grain refinement. Rare earth element (RE) still can form intermetallic compounds with other elements, disperse intermetallic compounds in the interior of the crystal grain and reduce the quantity and aggregation degree of intermetallic compounds $Cu_3P$ in the boundary of the crystal grain. The preferred content of Rare earth element (RE), Ti and B is less than 0.02 wt %.

The elements Al and Si in the alloy have the effects of deoxidization, solid solution strengthening and corrosion resistance improvement. If the content of Al and Si is higher, however, castability will decrease due to the increase in the quantity of oxidizing slag. Higher content of Si also will form brittle and hard y-phase, which will decrease plasticity of the invented alloy. Thus, the content of Al and Si is preferably among 0.1 to 0.5 wt %. A small quantity of Sn is added mainly to improve dezincification corrosion resistance. Sb can also improve dezincification corrosion resistance like Sn, and furthermore is beneficial for cuttability.

The features of the inventive alloy include: (a) the phase compositions of the inventive alloy mainly include alpha phase, beta phase and intermetallic compounds, $Cu_3P$; (b) P is one of the main elements for ensuring the cuttability of the inventive alloy; (c) Sb is complementary for the cuttability of the inventive alloy through a small quantity of brittle intermetallic compounds, Cu—Sb; and (d) multi-component alloying and grain refinement tends to uniformly disperse the intermetallic compounds in the interior and boundary of the crystal grain, and improves plasticity of the alloy.

The cost of necessary metal materials of the invented alloy is lower than lead-free free-cutting bismuth brass alloy and antimony brass alloy, and is equivalent to lead-containing brass alloy, as a result of the selection of alloy elements, and the design of element contents.

The manufacturing process of the invented alloy is as follows:

The raw materials used in the alloy in accordance with the invention include: electrolytic Cu, electrolytic Zn, brass scraps, Cu—P master alloy, Cu—Si master alloy, Cu—Ti master alloy, Cu—B master alloy, and optionally pure Sb, Sn, Al and Rare earth element (RE). The raw materials are combined in a non-vacuum intermediate frequency induction electric furnace, having a quartz sand furnace lining, in the following order:

First, electrolytic Cu, brass scraps, and covering agent that enhances slag removal efficiency are added to the furnace. These materials are heated until they have melted. Then the Cu—Si master alloy, Cu—Ti master alloy, and the Cu—B master alloy are added. Thereafter, pure Sb, Sn, Al and Rare earth element (RE) are optionally added. These materials are again heated until melted, and are thereafter stirred. Then electrolytic Zn is added. The melt is stirred, and slag is skimmed from the melt. The Cu—P master alloy is then added, and the melt is stirred further. When the melt reaches a temperature of 980 to 1000 degrees Celsius, it is poured into ingot molds.

The alloy ingots may be processed in different ways according to the method of the invention. First, the ingot may be extruded at a temperature among 550 to 700 degrees Celsius for about 1 hour with an elongation coefficient of greater than 30 to be formed, for example, into bar. Second, the ingot may be forged at a temperature among 570 and 680 degrees Celsius, to be formed, for example, into a valve body, or for manufacturing other water supply system components. Third, the ingot may be remelted and cast at a temperature of between 980 to 1010 degrees Celsius at a pressure of 0.3 to 0.5 Mpa for manufacturing faucets.

Smelting is processed in the atmosphere when protecting with the covering agent. Casting is processed at a temperature among 980 to 1000 degrees Celsius. The ingot is extruded at a temperature among 550 and 700 degrees Celsius with an elongation coefficient of greater than 30, and forged at a temperature among 570 to 710 degrees Celsius, or remelted to be cast at a temperature among 990 and 1010 degrees Celsius by low pressure die casting.

The advantages of this manufacturing process include the following. Casting ingots (rather than extruding bars) are used directly for hot-forging, and can thus reduce manufacturing costs. Ingot remelting is favorable to control the addition of the contents when in low pressure die casting. Extruding at a greater elongation coefficient could further refine grain and intermetallic compounds such as $Cu_3P$ and uniformly disperse intermetallic compounds and consequently decrease the negative effect on plasticity.

The inventive lead-free, bismuth-free free-cutting phosphorus brass alloy uses P instead of Pb and has been improved on cuttability, weldability and corrosion resistance; Furthermore, by multi-component alloying, grain refinement, large deformation degree and heat-treating, the intermetallic compounds $Cu_3P$ in granular form is dispersed in the interior and boundary of the crystal grain thereby improving workability and mechanical properties of the invented alloy. The invented alloy is applicable in spare parts, forging and castings which require cutting and particularly in forging and castings for a water supply system that requires cutting, grinding (polishing), welding and electroplating. The ingot (∫ 37 mm, h 60 mm) may be forged at different temperatures among 570 and 700 degrees Celsius, into valves with complex structures for water supply system. The production yield by disposable mold forging is 98.6%. The results from the research of mold forging indicate the invented alloy has excellent hot workability.

BRIEF DESCRIPTION OF THE DRAWINGS

To understand the present invention, it will now be described by way of example, with reference to the accompanying drawings in which.

EXAMPLES

Figure 1:
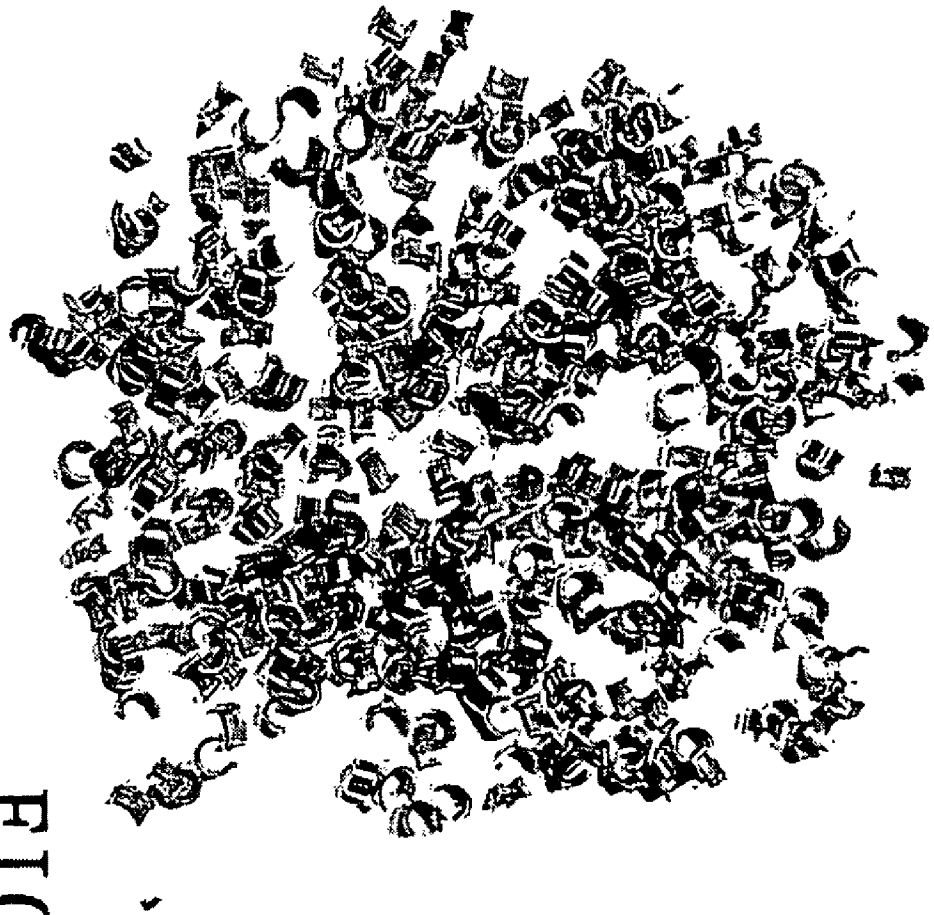
FIG. 1 shows the shapes of the cutting chips formed in Examples 1 and 2.

The alloy composition of examples 1 to 9 is shown in Table 1. The alloy ingots are for applications including forging, remelting and low pressure die casting, and for extruding into bar. The cuttability, castability, dezincification corrosion resistance and mechanical properties have been tested. Forging is processed at a temperature of between 570 to 700 degrees Celsius. The extruding is processed at a temperature of between 560 to 680 degrees Celsius. The low pressure die casting is processed at a temperature of between 980 to 1000 degrees Celsius. Stress relief annealing is processed at a temperature of between 350 to 450 degrees Celsius.

TABLE 1

| Composition of lead-free, bismuth-free free-cutting phosphorus brass alloy (wt %) | | | | | | | | | | |
|---|---|---|---|---|---|---|---|---|---|---|
| Examples | Cu | P | Sb | Si | Al | Sn | Ti | B | RE | Zn |
| 1 | 56.32 | 0.71 | 0.05 | 0.14 | — | 0.04 | 0.02 | 0.005 | — | Balance |
| 2 | 57.51 | 0.69 | 0.01 | 0.04 | 0.19 | 0.04 | — | 0.006 | — | Balance |
| 3 | 58.20 | 0.81 | 0.06 | 0.26 | 0.08 | 0.02 | — | 0.008 | — | Balance |
| 4 | 57.98 | 1.02 | 0.36 | 0.27 | 0.02 | 0.01 | — | 0.006 | — | Balance |
| 5 | 57.10 | 0.96 | 0.54 | 0.43 | 0.21 | — | — | 0.007 | — | Balance |
| 6 | 57.94 | 0.92 | 0.01 | 0.27 | 0.16 | — | 0.01 | 0.0008 | — | Balance |
| 7 | 58.07 | 0.83 | 0.09 | 0.24 | 0.06 | 0.01 | — | 0.005 | — | Balance |
| 8 | 58.25 | 1.28 | 0.03 | 0.16 | 0.06 | 0.03 | — | 0.002 | 0.003 | Balance |
| 9 | 57.53 | 1.57 | 0.01 | 0.28 | 0.10 | 0.06 | 0.01 | 0.0004 | 0.002 | Balance |

The lead-free, bismuth-free phosphorus brass alloy of the present invention has been tested, with results as follows:

Cuttability Test:

There are several indexes and methods for testing the cuttability of the alloy. The present invention tests the cuttability by measuring the cutting resistance and comparing the shapes of cutting chips. The samples for test are in the half-hard state. The same cutting tool, cutting speed and feeding quantity (0.6 mm) is approached. The relative cutting ratio is calculated by testing the cutting resistance of alloy C36000, and of the invented alloy:

$$\frac{\text{Cutting resistance of alloy } C36000}{\text{Cutting resistance of the invented alloy}} \times 100\% = \text{relative cutting raito}$$

Figure 2:
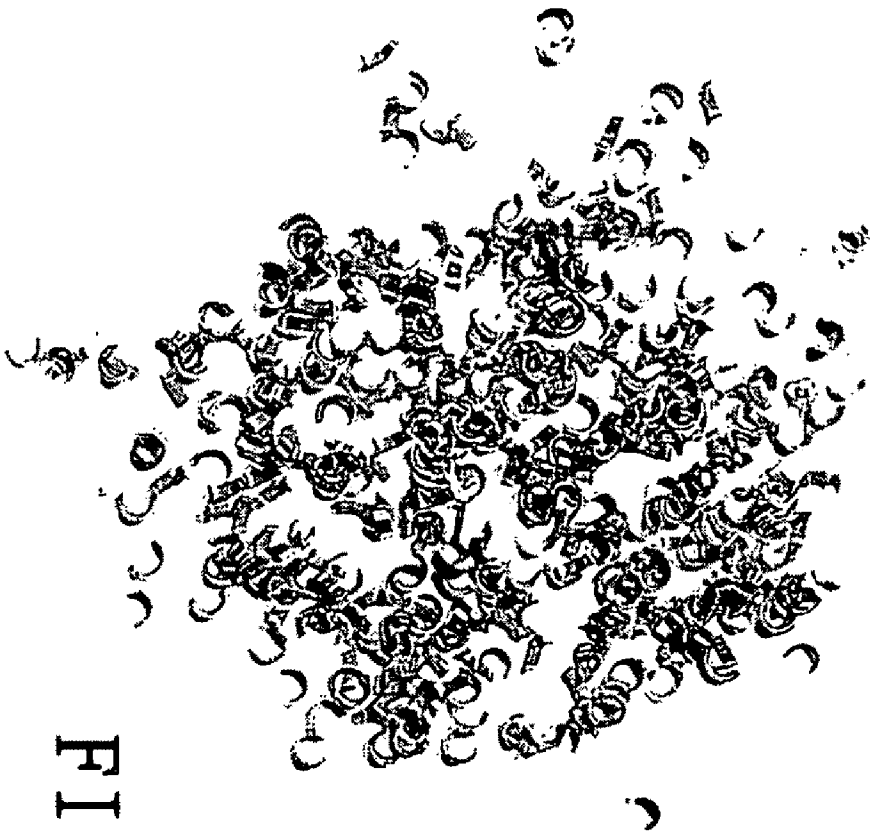
FIG. 2 shows the shapes of the cutting chips formed in Examples 3, 4, 5, 6 and 7.
Figure 3:
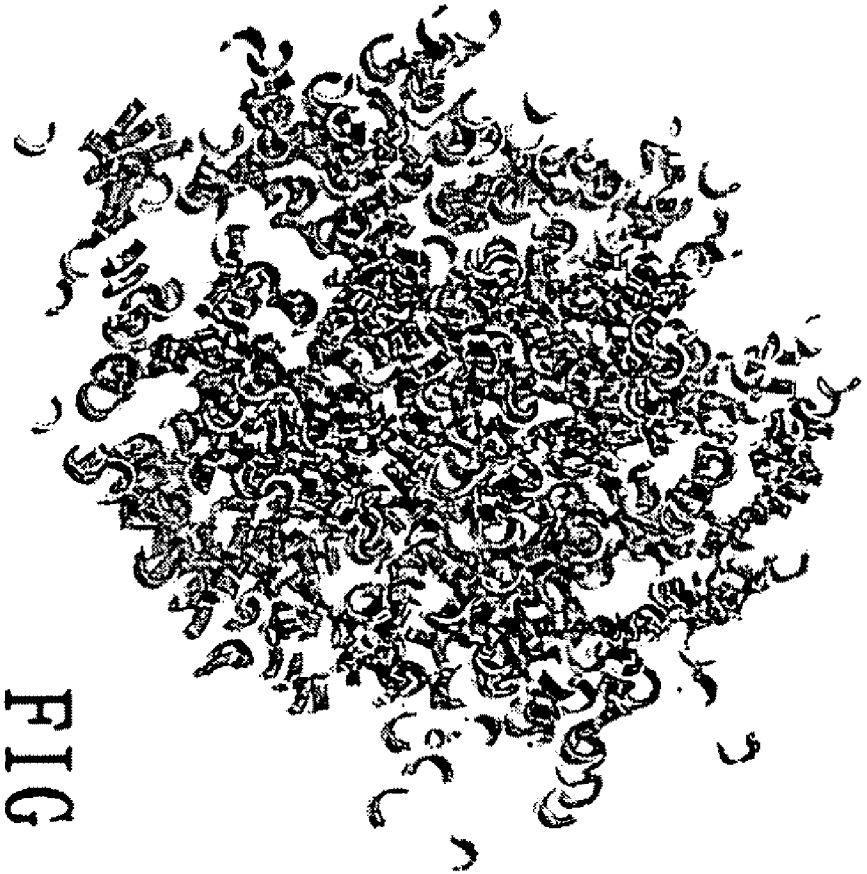
FIG. 3 shows the shapes of the cutting chips formed in Examples 8 and 9.
Figure 4:
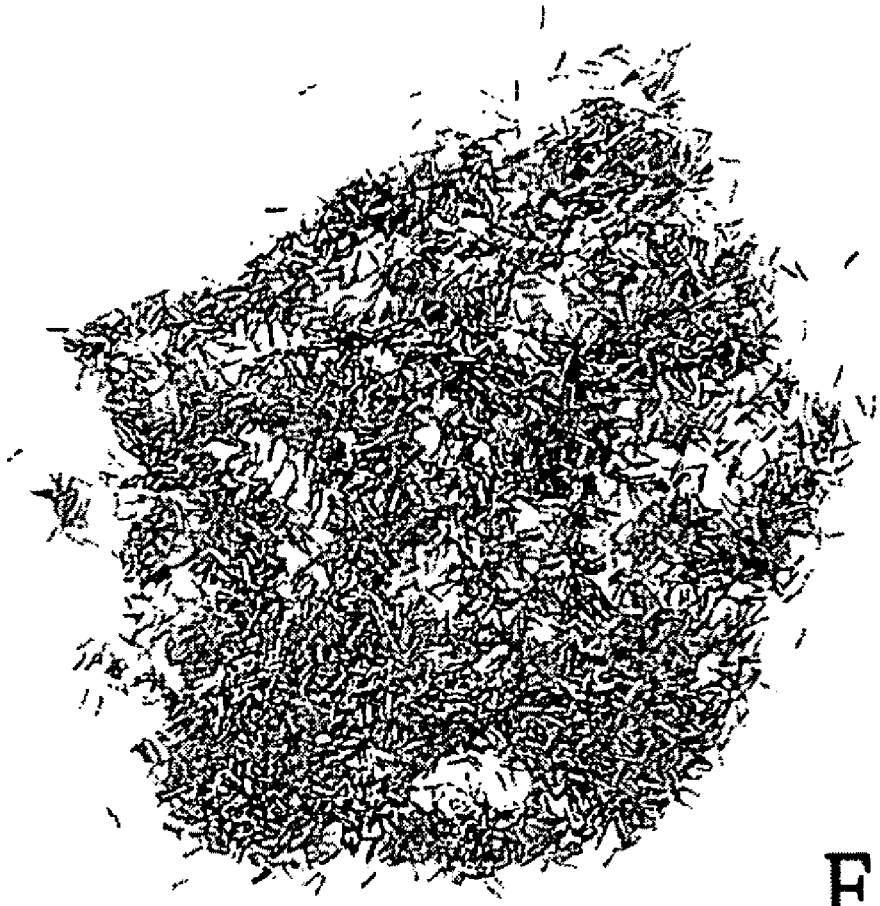
FIG. 4 shows the shapes of the cutting chips formed in cutting lead-containing brass alloy C36000, for comparison.

It's assumed that the cutting ratio of alloy C36000 is 100%. FIG. 4 shows the shapes of the cutting chips formed in cutting lead-containing brass C36000. Then the cutting ratio of examples 1 and 2 is ≧80% by testing the cutting resistance of alloy C36000 and examples 1 and 2 of the invented alloy. FIG. 1 shows the shapes of the cutting chips formed in Examples 1 and 2. The cutting ratio of examples 3, 4, 5, 6 and 7 is ≧85% by testing the cutting resistance of alloy C36000 and examples 3, 4, 5, 6 and 7 of the invented alloy. FIG. 2 shows the shapes of the cutting chips formed in Examples 3, 4, 5, 6 and 7. The cutting ratio of examples 8 and 9 is ≧90% by testing the cutting resistance of alloy C36000 and examples 8 and 9 of the invented alloy. FIG. 3 shows the shapes of the cutting chips formed in Examples 8 and 9.

Dezincification Corrosion Test:

Considering the invented phosphorus brass alloy will be mass produced to be castings by low pressure die casting, the samples for test are in the cast state. The samples of alloy C36000 for test are in the stress relief annealing state. The test for dezincification corrosion resistance is conducted according to PRC national standard GB 10119-88. The test results are shown in Table 2.

TABLE 2

| The results show dezincification corrosion resistance of lead-free, bismuth-free free-cutting phosphorus brass alloy | | | | | | | | | | |
|---|---|---|---|---|---|---|---|---|---|---|
| Examples | 1 | 2 | 3 | 4 | 5 | 6 | 7 | 8 | 9 | C36000 |
| Dezincification layer depth/μm | 150 | 120 | 125 | 140 | 60 | 110 | 130 | 135 | 180 | 610 |

Castability Test:

Several indexes can be used to measure the castability of the alloy. The present invention uses the standard samples in volume shrinkage, cylindrical, strip and spiral for testing the castability of the lead-free, bismuth-free free-cutting phosphorus brass alloy. For volume shrinkage samples, as may be seen in Table 3, if the face of the concentrating shrinkage cavity is smooth, and no visible shrinkage porosity in the bottom of the concentrating shrinkage cavity, it indicates castability is excellent and will be shown as "o" in Table 3. If the face of the concentrating shrinkage cavity is smooth but the height of visible shrinkage porosity in the bottom of the concentrating shrinkage cavity is less than 5 mm, it indicates castability is good, and will be shown as "Δ" in Table 3. If the face of the concentrating shrinkage cavity is not smooth and the height of visible shrinkage porosity in the bottom of the concentrating shrinkage cavity is more than 5 mm, it indicates castability is poor, and will be shown as "x" in Table 3. For strip samples, the linear shrinkage rate is not more than 1.5%. For cylindrical samples, as may be seen in Table 3, if no visible shrinkage crack is shown, it indicates castability is excellent and will be shown as "o" in Table 3. If the visible shrinkage crack is shown, it indicates the castability is poor, and will be shown as "x" in Table 3. Spiral samples are for measuring the flowability of the invented alloy. The pouring temperature of each alloy is about 1000 degrees Celsius. The results are shown in Table 3. It indicates the castability of the phosphorus brass alloy is excellent.

TABLE 3

The results show the castability of the lead-free, bismuth-free free-cutting phosphorus brass alloy

| Examples | 1 | 2 | 3 | 4 | 5 | 6 | 7 | 8 | 9 | C36000 |
|---|---|---|---|---|---|---|---|---|---|---|
| Volume shrinkage samples | ○ | ○ | ○ | ○ | ○ | ○ | ○ | ○ | Δ | ○ |
| Cylindrical samples | ○ | ○ | ○ | ○ | ○ | ○ | ○ | ○ | ○ | ○ |
| Melt fluid length/mm | 480 | 470 | 485 | 480 | 470 | 480 | 515 | 540 | 545 | 460 |
| Linear shrinkage rate/% | | | | | ≦1.7 | | | | | 1.95~2.15 |

2. Mechanical Properties Test:

The samples for test are in the half-hard state. The specification is ϕ6 mm bar. The test results are shown in Table 4.

TABLE 4

The results show the mechanical properties of the lead-free, bismuth-free free-cutting phosphorous brass alloy

| Examples | 1 | 2 | 3 | 4 | 5 | 6 | 7 | 8 | 9 | C36000 |
|---|---|---|---|---|---|---|---|---|---|---|
| Tensile strength/MPa | 535 | 505 | 530 | 545 | 530 | 515 | 525 | 530 | 500 | 485 |
| 0.2% Yield strength/MPa | 380 | 350 | 390 | 415 | 385 | 380 | 400 | 405 | 380 | 340 |
| Elongation/% | 11 | 12.7 | 10.5 | 10.0 | 10.0 | 11.0 | 10 | 9 | 8.9 | 9 |

3. Stress Corrosion Test:

The samples for test are from extruded bar, castings and forging. Stress corrosion test is conducted according to PRC's national standard GB/T10567.2-1997, Ammonia fumigation test. The test results show no crack appears in the face of the samples.

What is claimed is:

1. A lead-free, bismuth-free free-cutting phosphorous brass alloy consisting of: zinc, in an amount exceeding 41 wt %; 56.0-58.25 wt % copper, in an amount such that the amount of zinc and copper totals between 97.0 wt % and 99.5 wt %; 0.59 to 1.6 wt % P; and other elements in an amount between 0.005 and 0.6 wt %, which comprise at least two elements selected from the group consisting of A1, Si, Sb, Sn, Rare earth element (RE), Ti and B; and the balance being unavoidable impurities; wherein the elements phosphorus and copper form an intermetallic compound $Cr_3P$; and wherein the at least two other elements comprise B and an element selected from the group consisting of A1, Si, Sb, or Ti.

2. The lead-free, bismuth-free free-cutting phosphorous brass alloy of claim 1, wherein the amount of P is between 0.59 and 1.35 wt %.

3. The lead-free, bismuth-free free-cutting phosphorous brass alloy of claim 2, wherein the amount of P is between 0.59 and 0.8 wt %.

4. The lead-free, bismuth-free free-cutting phosphorous brass alloy of claim 1, wherein Fe is the unavoidable impurities, and the content of Fe is less than 0.05 wt %.

* * * * *